US005410829A

United States Patent [19]

Schwab et al.

[11] Patent Number: 5,410,829

[45] Date of Patent: May 2, 1995

[54] DISPLAY ARRANGEMENTS

[75] Inventors: Frank Schwab, Starzach; Thomas Wahr, Balingen/Hesselwangen, both of Germany

[73] Assignee: Kerstin Schwab, Starzach, Germany

[21] Appl. No.: 938,006

[22] Filed: Aug. 27, 1992

[30] Foreign Application Priority Data

Aug. 30, 1991 [GB] United Kingdom ..... 9118666

[51] Int. Cl.[6] ..... G09F 19/08

[52] U.S. Cl. ..... 40/414; 40/457; 446/298; 223/66

[58] Field of Search ..... 40/414, 423, 457; 446/175, 298; 223/66, 68, 71, 84

[56] References Cited

U.S. PATENT DOCUMENTS

| | | | |
|---|---|---|---|
| 1,685,358 | 9/1928 | Harcourt | 223/66 X |
| 4,801,285 | 1/1989 | Yeu | 446/298 |
| 4,805,816 | 2/1989 | Freund | 223/66 |
| 4,824,416 | 4/1989 | Chun-Hoi et al. | 446/298 |
| 4,875,886 | 10/1989 | Sung | 446/298 |
| 5,134,796 | 8/1992 | Satoh et al. | 446/175 X |
| 5,176,560 | 1/1993 | Wetherell et al. | 446/175 |

FOREIGN PATENT DOCUMENTS

| | | | |
|---|---|---|---|
| 990746 | 9/1951 | France | 223/66 |

*Primary Examiner*—Richard K. Seidel
*Assistant Examiner*—Raymond D. Woods
*Attorney, Agent, or Firm*—Christie, Parker & Hale

[57] ABSTRACT

A display arrangement comprises a dancing body torso of plastics material. The lower and upper display halves of the torso are spaced apart. The upper display half is pivotally supported by a support carried by the lower display half. A motor secured to the support is coupled to the upper display half to cause it to oscillate about is pivotal axis. A support bracket secured to the support and the lower display half has a pair of feet which can be secured to a ground engaging member.

11 Claims, 3 Drawing Sheets

DISPLAY ARRANGEMENTS

BACKGROUND AND SUMMARY

The present invention relates to display arrangements for displaying clothing.

It is known to display clothing such as swimwear and underwear on shells of plastic material. Such shells can take the form of the front half of a male or female torso. The shell is preferably of rigid transparent plastics material having a thickness of 1 to 2 mm.

The shell has a J-shaped recess in the region of the neck to allow it to be suspended from a hanging rail.

The advantage of such shells is that they can be readily stacked one upon the other even when they carry clothing to be displayed. Because the clothing is stretched tightly on the shell there is little or no risk of creasing when stacked, and the shells can be nested one within the other so that the stack is very compact for transportation.

The stack can be readily unpacked and the clothing can be arranged for display very quickly.

It is an object of the present invention to provide an improved display arrangement.

According to the present invention there is provided a display arrangement comprising a lower display portion, a support upstanding from said lower display portion and pivotally supporting an upper display portion and drive means coupling said lower display portion to said upper display portion to cause said upper portion to oscillate about its pivotal axis.

Other advantages, features and objects of the invention will become apparent from the specification and drawings.

BRIEF DESCRIPTION OF THE DRAWINGS

A display arrangement embodying the present invention, will now be described, by way of example, with reference to the accompanying diagrammatic drawings, in which.

DETAILED DESCRIPTION OF THE PREFERRED EMBODIMENT

The display arrangement to be described is arranged to promote the sale of display shells.

Figure 1:
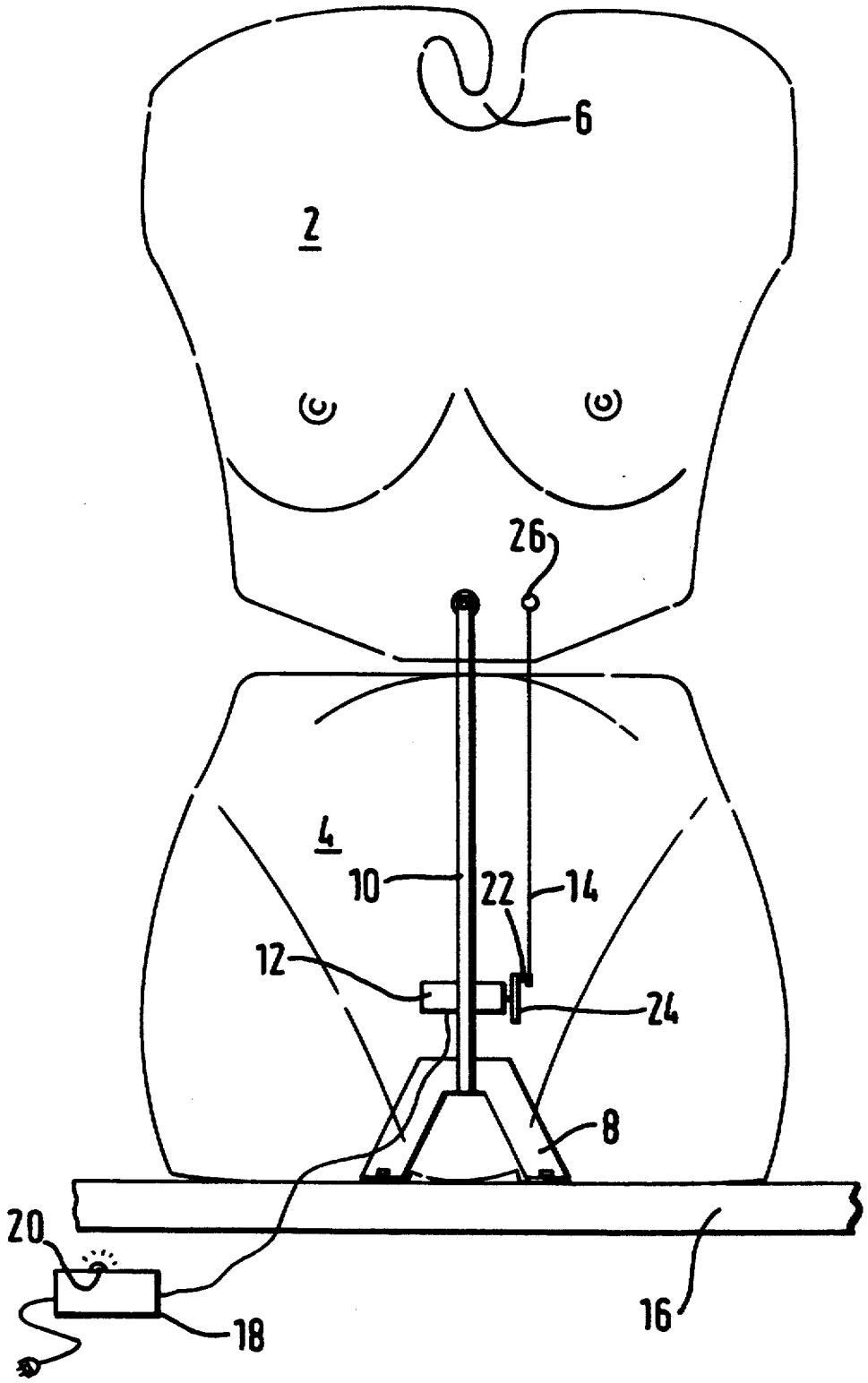
FIG. 1 is a front elevation of the display arrangement.

As shown in FIG. 1 the display arrangement comprises a body shell in the form of a female torso. The body shell is of rigid plastics material and is in two separate halves; an upper display half 2 and a lower display half 4. The upper half 2 is provided with a J-shaped recess 6 in the region adjacent the neck. The lower half 4 is secured to a support bracket 8 which in turn is secured to a block 16 of wood or other material so as to support the lower half 4 in an upright manner from the ground. An elongate support member 10 of U-shaped cross-section is secured to the bracket 8 and the lower half 4 at least in the lower and upper regions thereof. The upper end of the member 10 is pivotally connected to a lower region of the upper half 2 by means of a nut, a bolt and a washer so that the upper half 2 can sway or oscillate from side to side with respect to the lower half 4. When the upper and lower halves are enveloped in a one piece swim-suit this gives the impression of the torso dancing.

The support member 10 carries a motor 12 having a shaft supporting a rotary disc 24. A pin 22 projects from the disk 24. Another pin 26 projects from the upper half 2 to a location spaced from the point at which the support member 10 is pivotally connected. A lift rod 14 interconnects the two pins. In operation when the motor 12 is energize, the lift rod 14, because it is connected to disk at a location spaced from the rotary axis, rises and drops as the disk rotates. This in turn tilts the upper half 2 from side to side to effect the dancing motion.

The motor 12 operates under the control of an electric circuit encased in a housing 18. The circuit includes an acoustic detector which responds to ambient noise to energize the motor 12. A bulb 20 on the housing 18 is illuminated whenever the motor 12 is energised.

Figure 2:
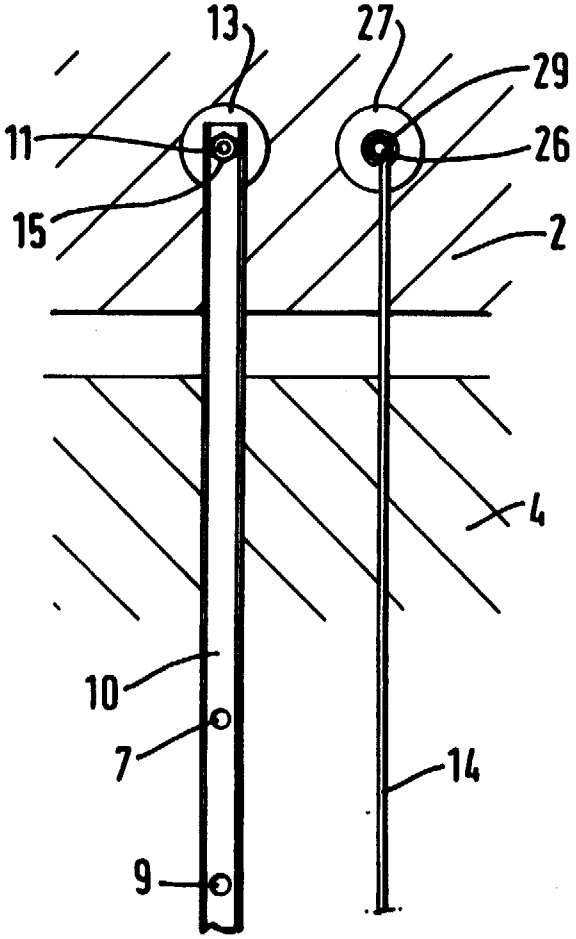
FIG. 2 is a detail to an enlarged scale of the arrangement of FIG. 1.

FIG. 2 shows the connection of the support member 10 and the lift rod 14 to the upper half in more detail. As shown the pin 26 is in the form of a bolt. The upper end of the lift rod 14, which is profiled like a question mark, is hooked around the bolt 26. A washer 27 lies between the rod 14 and the upper half, and a nut 29 holds the rod 14 captive on the bolt 26. Similarly the support member 10 is secured to the upper half 2 by a bolt 11. A washer 13 lies between the upper half 2 and the support member 10, and a nut 15 holds the support member 10 captive to the bolt 11. Also as shown, the support member 10 has two bolt holes 7 and 9 through which an upper portion of the lower half 4 is secured to the support member 10.

Figure 3:
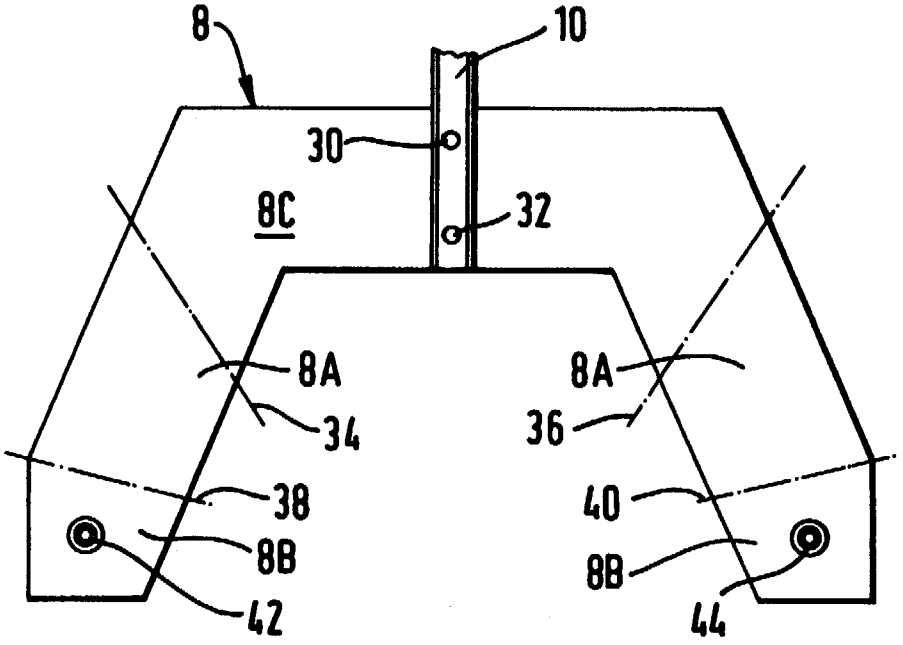
FIG. 3 is a plan view of a support member of the arrangement before being bent into shape.

As shown in FIGS. 3 the bracket 8 has a central section 8C which is secured to the support member 10 by two bolts 30 and 32. Two legs 8A depend from the central section 8C and a foot 8B extends from each leg. The legs 8A are bent about bend lines 34 and 36 with respect to the central section 8C and the feet 8B are bent about ben lines 38 and 40 with respect to the legs 8A. The central section 8C thus lies in a vertical plane, the feet 8B lie in a horizontal plane and the legs 8A lie in intermediate planes. The feet 8B have threaded openings 42 and 44 by means of which they can be secured to the wooden block 16 and to a flange (not shown) extending from the base of the lower shell half 4.

Figure 4:
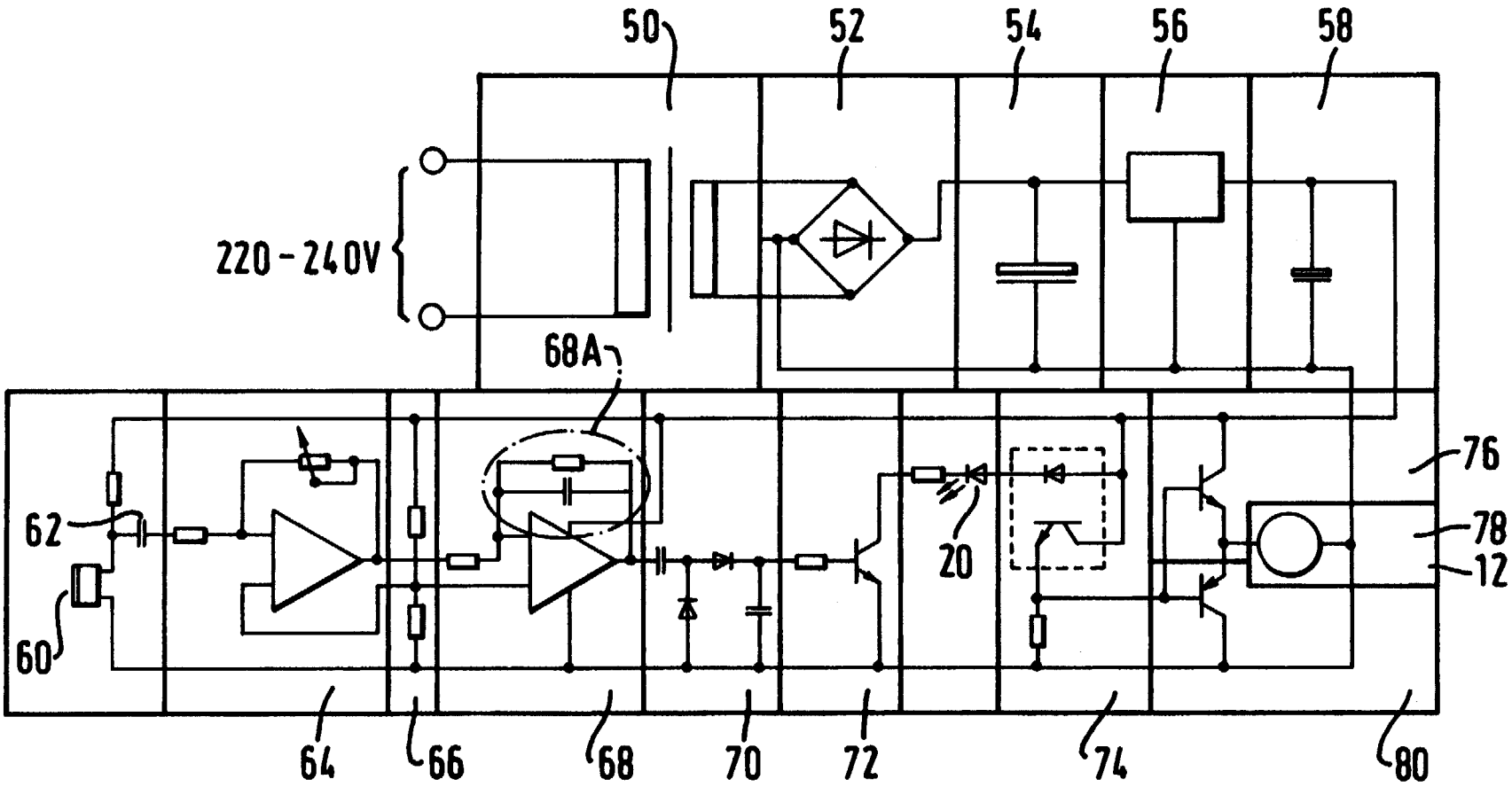
FIG. 4 is a circuit diagram of the arrangement.

The control circuit shown in FIG. 4 includes a power supply comprising a transformer 50, a full wave rectifier 52, a filter 54, a voltage regulator 56 and a smoothing circuit 58.

The operative part of the circuit includes a microphone 60 which is coupled by a coupling capacitor 62 to a pre-amplifier circuit 64. A voltage divider 66 provides a reference voltage. The output of the pre-amplifier 64 and the reference voltage are compared by a differential amplifier circuit 68. The differential amplifier has a filter 68A in its feedback circuit so that the amplifier circuit 68 will only generate an output in response to signals in the frequency range of from 20 to 94 Hz.

The output of the amplifier circuit 68 is fed through a wave shaping circuit 70 to a drive circuit 72. The output of the drive circuit is fed through the series combination of a light emitting diode (which forms the lamp 20) and an opto-coupler 74. The output of an opto-coupler feeds a transistor 76 which controls the energization of the motor 12 in the motor block 78. A second transmitter 80 acts to short circuit the motor 12 when the motor is deenergized to reduce undesirable voltage spikes.

In operation the motor 12 is only energised when the microphone 60 senses bass signals of a certain magnitude in the frequency range of from 20 to 94 Hz. The circuit is thus particularly responsive to the noise of approaching feet as opposed to higher pitched sounds.

While in the foregoing description we have disclosed details of the invention for purposes of illustration it will be understood that many of these details may be varied without departing from the spirit and scope of the invention.

I CLAIM:

1. A clothing display arrangement for supporting clothing to be displayed, the arrangement comprising:

a lower hip-shaped torso display portion;

a support upstanding from and fixed relative to said lower hip-shaped torso display portion;

an upper chest-shaped torso display portion;

pivotal means pivotally supporting the upper chest-shaped display portion on the support for pivotal movement about a pivotal axis; and drive means coupling said lower hip-shaped display portion to said upper chest-shaped display portion to cause said upper chest-shaped portion to oscillate about said pivotal axis.

2. An arrangement according to claim 1 wherein said drive means includes a sound sensor, and means coupling the sound sensor to the drive means to activate said drive means in response to receipt of a signal of predetermined magnitude and lying within a predetermined frequency band.

3. An arrangement according to claim 2 wherein said predetermined frequency band extends from 20 to 94 Hz.

4. An arrangement according to claim 1 wherein said drive means comprises:

an electric motor rigidly secured to said support;

a rotary disk coupled to said motor; and a lift rod having first and second ends with said first end being secured to an eccentric location on said disk and said second end secured to a point on said upper display portion spaced from said pivotal axis.

5. An arrangement according to claim 4 including signalling means for providing a light signal when said electric motor is energized.

6. An arrangement according to claim 4 wherein the drive means comprises a microphone for detecting a signal, a differential amplifier for comparing the output of the microphone with a reference signal, and having a feedback path, and a filter circuit in the feedback path differential amplifier whereby the differential amplifier will only provide an output when the signal detected by the microphone lies in a predetermined frequency band and exceeds a predetermined amplitude.

7. An arrangement according to claim 4 including means for short circuiting said electric motor when said motor is deenergized.

8. An arrangement according to claim 1 including a bracket secured to said lower display portion and having means by which said bracket is secured to a ground engaging member.

9. An arrangement according to claim 8 wherein said support is rigidly secured to said bracket.

10. An arrangement according to claim 8 or to claim 9 wherein said bracket has a pair of spaced feet for coupling to said ground engaging member.

11. An arrangement according to claim 1 wherein the pivotal axis extends generally horizontally.

* * * * *